US005533666A

United States Patent [19]

Cromwell

[11] Patent Number: 5,533,666

[45] Date of Patent: Jul. 9, 1996

[54] OCTAGONAL BOX STRUCTURE

[75] Inventor: Arthur H. Cromwell, Columbus, Ohio

[73] Assignee: Willamette Industries Inc., Portland, Oreg.

[21] Appl. No.: 489,433

[22] Filed: Jun. 12, 1995

[51] Int. Cl.[6] ..... B65D 5/08

[52] U.S. Cl. ..... 229/109; 229/138; 229/184

[58] Field of Search ..... 229/109, 110, 229/137, 138, 184

[56] References Cited

U.S. PATENT DOCUMENTS

| | | | |
|---|---|---|---|
| 2,047,804 | 7/1936 | Shapiro | 229/138 |
| 2,091,291 | 8/1937 | Ringler | 229/109 |
| 3,253,767 | 5/1966 | Pellaton | 229/109 |
| 3,523,635 | 8/1970 | Croley et al. . | |
| 3,977,594 | 8/1976 | Swan | 229/184 |
| 4,502,624 | 3/1985 | Burrell | 229/184 |
| 4,717,022 | 1/1988 | Combs | 229/109 |
| 5,390,750 | 2/1995 | Straub et al. | 229/109 |
| 5,400,955 | 3/1995 | Coalier et al. | 229/109 |

FOREIGN PATENT DOCUMENTS

| | | | |
|---|---|---|---|
| 2221897 | 2/1990 | United Kingdom | 229/138 |

*Primary Examiner*—Gary E. Elkins
*Attorney, Agent, or Firm*—Francis T. Kremblas, Jr.

[57] ABSTRACT

An octagonal box structure comprising eight upstanding side wall panels and eight closure flaps integrally connected to one another and to the side wall panels for folding inwardly along a generally horizontal score hinge line to close an end of the box structure. The side wall panels include four smaller panels having a width dimension of about 20 to 40 percent of the width dimension of the narrowest pair of the remaining four side wall panels. The closure flaps have a width corresponding to the width of the side wall panel from which they depend. Four of the closure flaps include diagonally extending score hinge lines to permit each of these closure flaps to fold inwardly in partial overlapping relationship upon itself and the next adjacent closure flap to form a closed end of the box. The diagonal score lines are formed at an angle between about 20 to 25 degrees relative to an extension of the vertical score lines which define the width of each closure flap.

5 Claims, 11 Drawing Sheets

OCTAGONAL BOX STRUCTURE

TECHNICAL FIELD

The present invention relates generally to a fiberboard box structure, a method of setting up the box and an apparatus for setting up the box along predetermined score lines.

BACKGROUND ART

Fiberboard boxes have been made for many decades in several designs, the most usual consisting of a square or rectangular configuration having a flat top or bottom surface formed by four closure flaps. Pre-cut slots or slits extending along a vertical edge of each flap separate each flap at each corner of the box to permit the flaps to be folded inwardly to close the top or bottom end of the box.

In applications where such boxes are used for containing a flowable bulk material, the usual slotted box configuration lacks strength around the horizontal score line between the bottom closure flaps and the vertical side walls which causes bulging of the side walls near this location. This is referred to as "elephant's foot" in the trade.

One attempted prior solution to this problem is represented in U.S. Pat. No. 3,523,635. This patent discloses a four-sided fiberboard box having a strengthened, corner and four flaps integrally joined along the horizontal score line forming the bottom edge of the box. Two of the opposed flaps are folded inwardly along diagonal score lines while the other two flaps are rectangular and fold inwardly toward one another. The flaps having the diagonal scored fold lines form a triangular shaped flap. This construction offered some improvement over the slotted box configuration because the bottom flaps are an integral extension of the side walls, however, this patent still teaches the need for an additional overlapping corner joint to strengthen the four sided box in order to provide an increase in strength over the slotted flap version.

When fiberboard boxes are used to contain flowable bulk materials in relatively large amounts which are stacked one upon the other, increased stacking strength and resistance to bulging of the side walls at or near the bottom is highly desirable. Some bulk bin box constructions have been proposed utilizing an equal sided octagon configuration in the form of a tube which requires a separate fitted top and bottom closure portion which are fixed to the tube by strapping, adhesive or staples, for example. Such constructions offer improved strength, however, at significantly increased costs of labor and at a significant decrease in volume per unit height compared to a conventional rectangular box configuration. Prior to the present invention a more economical box construction which provides increased strength in this regard without significant sacrifice of volume or storage space has eluded those skilled in the art.

BRIEF DISCLOSURE OF INVENTION

The present invention relates generally to fiberboard box construction and methods and apparatus for setting up such boxes and particularly to a novel and improved box configuration and methods and apparatus for setting up such an improved box.

In accordance with the present invention, an eight-sided box configuration is disclosed wherein the flat bottom portion includes eight closure flaps integrally joined along horizontal score lines forming hinges joining the vertical side walls or panels of the box. Upon folding the closure flaps inwardly, the bottom end of the box is closed. The eight side panels and the eight closure flaps are formed along horizontally spaced, vertical score fold lines which correspond to each corner of the box and a common horizontal hinge score line. Preferably four of the side panels and the corresponding closure flaps are of equal width dimensions, which width dimension is less than one-half the width of at least the smaller of the remaining four panels and corresponding closure flaps. The side panels are arranged in pairs consisting of parallel, spaced panels. Generally, it is most preferred that the four smaller width side panels and their associated closure flaps are of no greater width than is practical to fold inwardly along the vertical score fold lines forming the corners of the box and yet wide enough to provide a sufficient increase in strength associated with having eight sides as compared to the conventional four-sided box.

In practice, it has been found that the width of the four smaller side panels and their associated closure flaps may be in the range of about 20 to 40 percent of the width of the smaller of the remaining two pair of side panels to obtain significant strength increases while maintaining reasonable foldability during set up of the box. This preferred embodiment minimizes the decrease in volume relative to the height of the box and maintains reasonable efficiency of storage space for the stacking and arranging the set-up boxes after being filled.

The larger two pair of closure flaps associated with the four larger side panels include a pair of converging diagonal score fold lines. Each diagonal score line extends from an adjacent corner of the box to the outer free edge of a respective closure flap forming a predetermined angle with the vertical score lines on the closure flaps of the box blank.

During set up of the box, when these larger two pair of closure flaps are folded inwardly along these diagonal score lines and the extended vertical score lines, each is folded in partial overlapping relationship upon itself and the four smaller closure flaps having a rectangular configuration fold in a partial overlying relationship to the adjacent closure flaps folded along the diagonal score fold lines. This feature in the eight-sided box configuration of the present invention provides very significantly improved strength gains along the perimeter of the bottom of the box to effectively improve resistance to bulging of the side panels particularly advantageous when the box contains flowable materials.

The configuration described above, particularly when using a weight of the fiberboard material generally required to handle a relatively large volume of bulk material, is difficult, if not economically impractical to set up manually. However, a relatively simple process and apparatus is disclosed herein which handles the set-up operation in a convenient, fast and economical manner to assure properly obtaining the necessary folding along the vertical, horizontal and diagonal score lines to form the opened box configuration desired.

DETAILED DESCRIPTION

Figure 1:
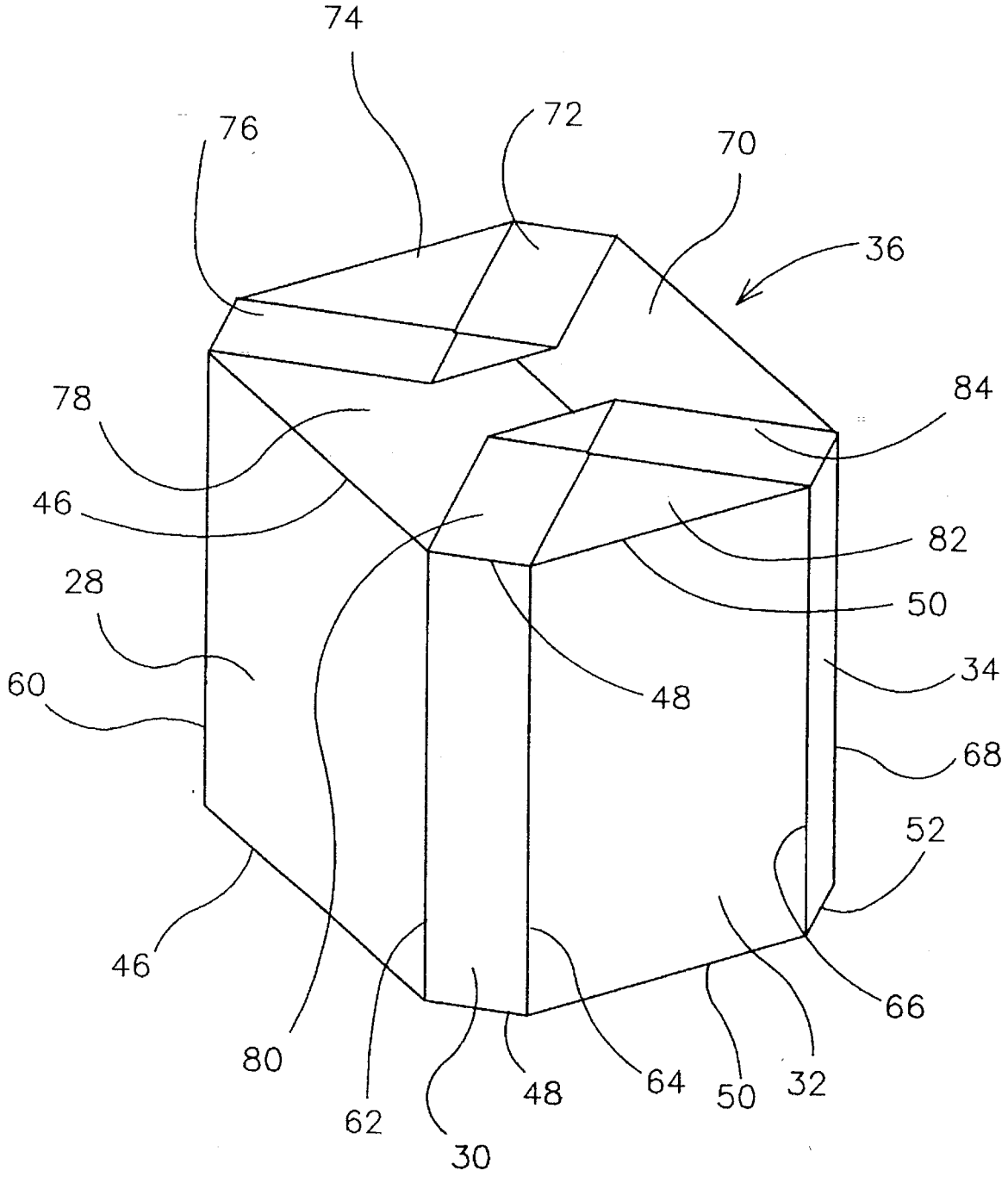
FIG. 1 is a perspective view of a fiberboard box construction in accordance with the present invention shown in a set-up condition with the bottom closure flaps completely closed with the bottom surface facing upwardly.
Figure 2:
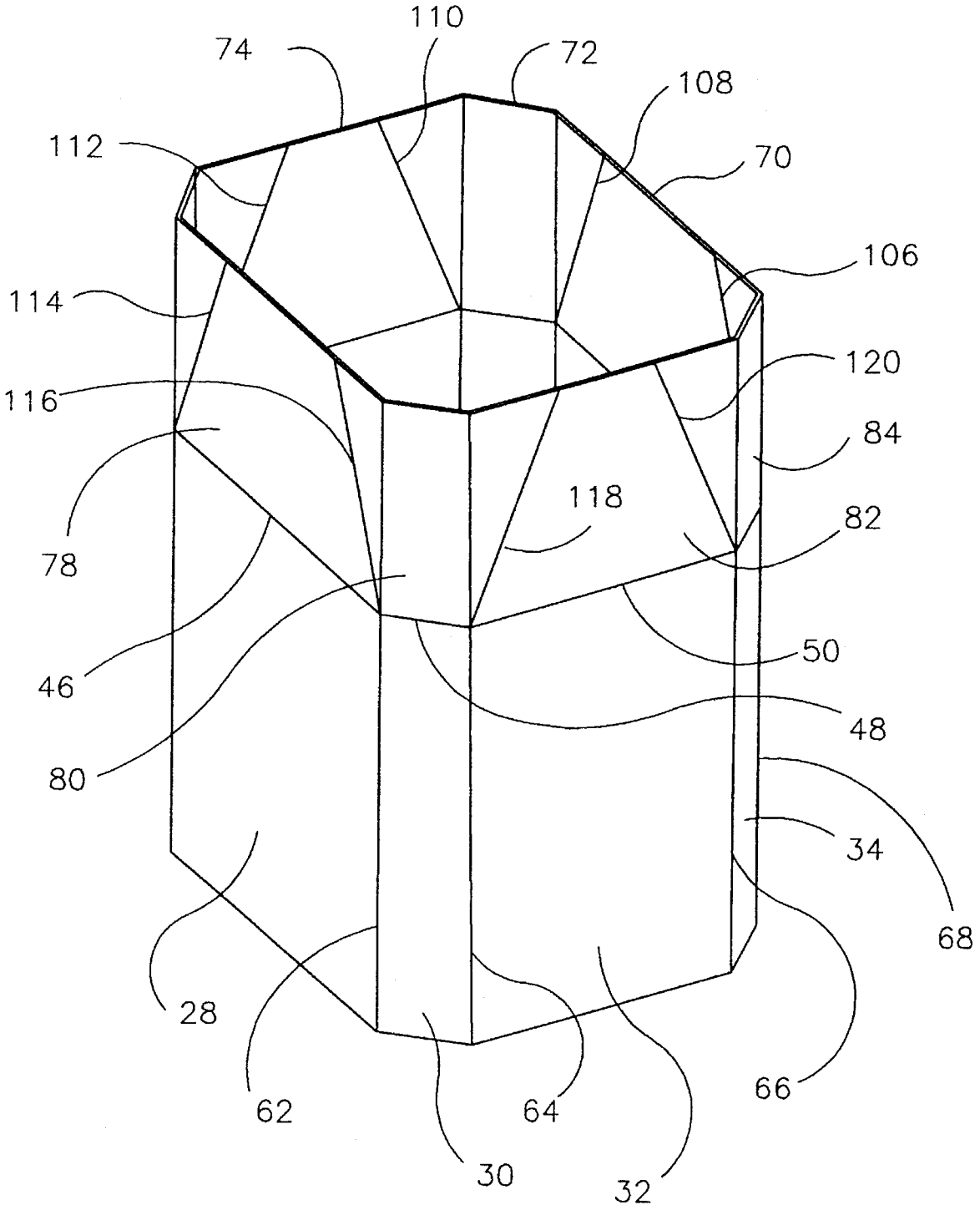
FIG. 2–5 are perspective views illustrating how the bottom closure flaps are folded in progressive stages from fully open toward a closed position as seen in FIG. 1.
Figure 3:
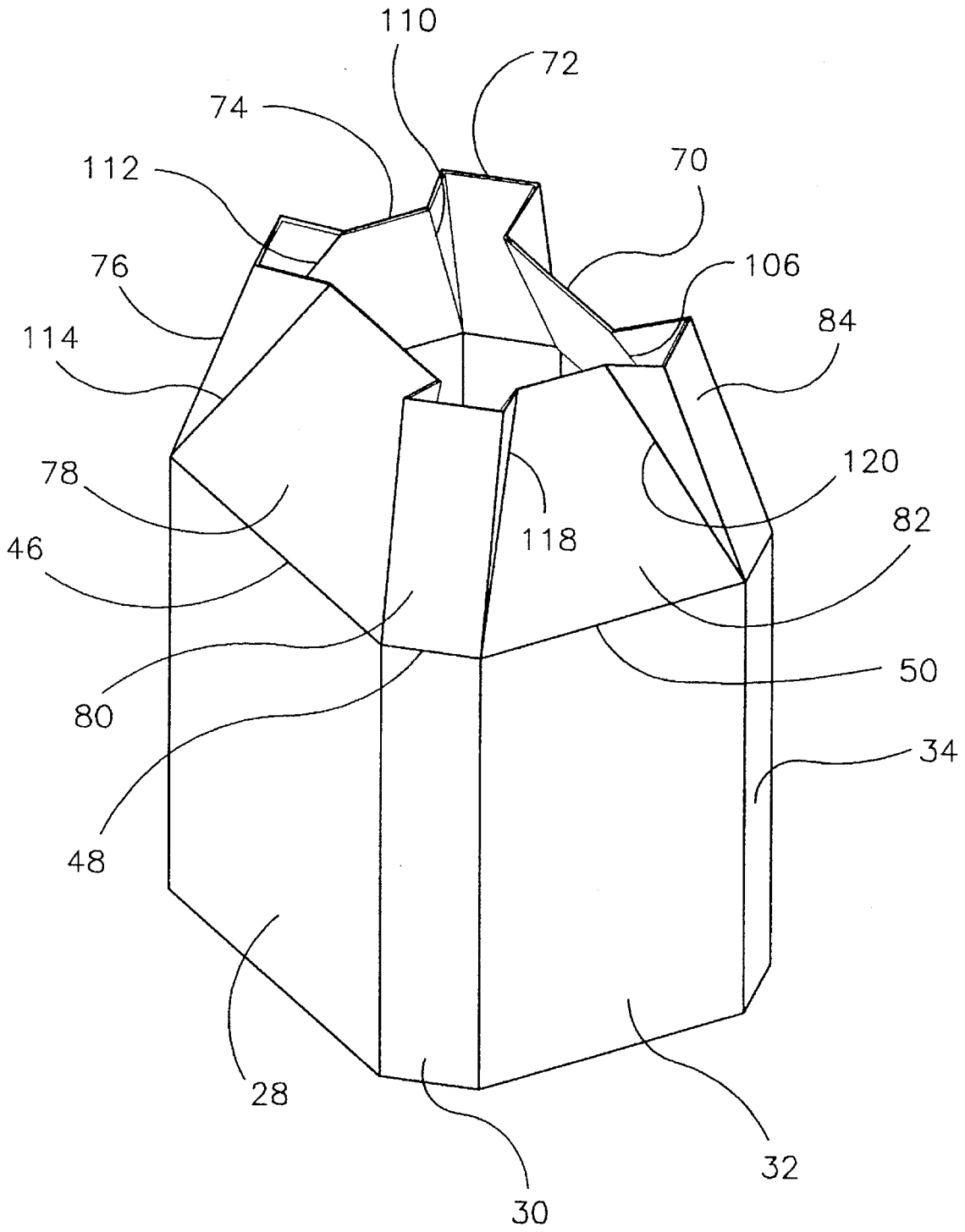
Figure 6:
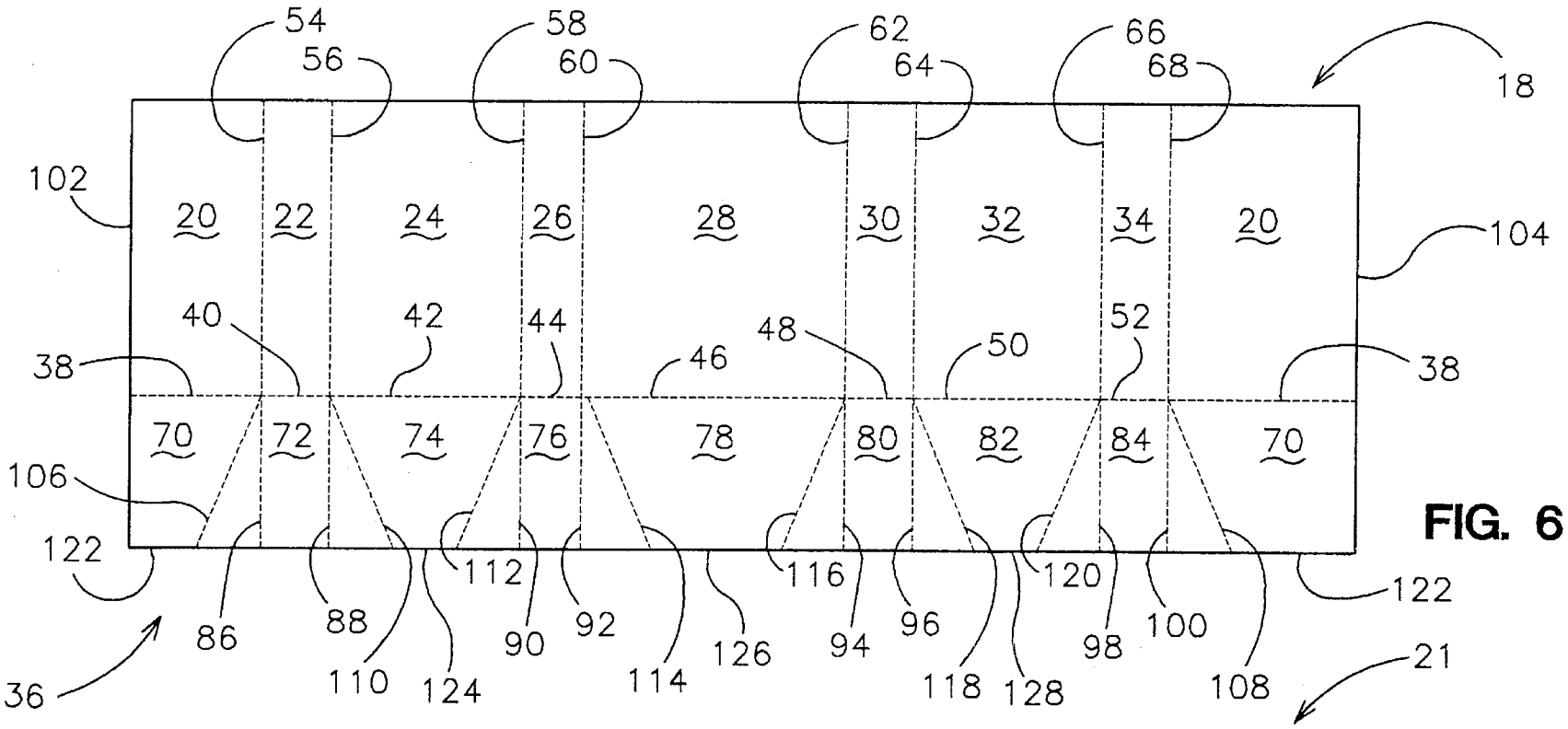
FIG. 6 is a plan view of a box blank from which the box shown in FIG. 1 may be formed illustrating the novel disposition of the scored fold lines along which the various side panels and bottom closure flaps are formed upon folding.

An improved fiberboard box configuration made in accordance with the present invention is illustrated in FIGS. 1–7. Referring to FIGS. 1 and 6 respectively, a box in its fully set up condition and a planar box blank for forming the box are shown. The box is provided with eight vertically extending side panels 20, 22, 24, 26, 28, 30, 32 and 34 and a generally horizontally disposed bottom, indicated generally at 36. Bottom 36 is formed by a plurality of closure flaps which are integrally connected to each other and the side panels along common horizontal score lines forming horizontal hinges numbered 38 through 52. The vertically disposed side wall panels are also integrally connected to one another along the horizontal score lines 38–52 and at the respective vertically extending score lines 54 through 68 which also define the eight corners of the box.

A suitable closure or cap placed on the opposing end relative to bottom 36 is usually included in most applications, and a sealable plastic bag is often inserted into the box in a well-known, conventional manner. However, a conventional top closure cap and means for attaching the same are not material for purposes of describing the present invention for full understanding by one of ordinary skill in the art.

The four narrower side panels 22, 26, 30 and 34 are essentially equal in width, while the remaining opposing pair of panels 20 and 28 and 24 and 32 may be equal to one another or more preferably be made of different widths. However, in either case, both are significantly wider than the four, narrower panels 22, 26, 30 and 34.

The four narrower panels 22, 26, 30 and 34 preferably have a width in a range of about 20 to 40 percent of the width of the narrowest of the remaining two pair of side panels for the typical sizes of bulk bins usually employed in the industry. In selecting the appropriate width of these four narrower side wall panels and the associated corresponding four closure flaps as described later herein, it is desirable to minimize their width to increase the volume of the box or bulk bin per unit of height of the octagonal configuration formed. However, this selected width must be great enough to obtain a significant increase in strength associated with having eight corners, as opposed to the conventional four corner box structure, and to maintain reasonable foldability of the score fold lines. Additionally, the preferred configuration such as shown in the drawings, conforms sufficiently close to a conventional four sided box to minimize loss of storage space when such boxes are stored in a conventional manner in adjacent and/or stacked relationship.

As best seen in FIGS. 1 and 6, bottom 36 of the box comprises eight flaps, 70 through 84, which are inwardly folded in partially overlapping relationship to portions of the immediately adjacent flaps. The four narrower rectangular closure flaps 72, 76, 80 and 84 are folded in a single thickness of the original construction material and are associated with a width corresponding to the width of side panels 22, 26, 30 and 34. Further, they are also integrally joined to these side panels along the horizontal score fold lines 40, 44, 48 and 52.

The width of all the closure flaps 70–84 are defined by vertical score lines 86–100 which are aligned with and are extensions of the vertical score lines 54–68 previously referenced which form the eight corners of the box.

It should also be noted that the box blank shown in FIG. 6 will be folded such that outer ends 102 and 104 are preferably overlapped a predetermined distance and connected together by a suitable adhesive or other conventional fastening means well-known in the industry to form what is referred to as a manufacturer's joint. This closes the sides of the box. The vertical score fold lines 58 and 66 and 90 and 98 are initially folded to form the overlapped manufacturer's joint referred to above. Upon forming the manufacturer's joint as described, the blank is now formed into a planar closed tube which may also be referred to as a flat, closed box form which is more convenient to handle and ship. Typically, this planar closed box or tube is shipped to the user for set-up into an open box configuration for its intended use as will be described later herein.

With continued reference to the box blank shown in FIG. 6, the bottom closure flaps 70, 74, 78 and 82 are provided with diagonal score lines 106 and 108, 110 and 112, 114 and 116 and 118 and 120 respectively. These diagonal score lines extend from the intersection with a respective one of the horizontal score lines 38–52 at each corner of the box to the outer or free edges 122, 124, 126 and 128 of a respective flap 70, 74, 78 and 82 at an angle preferably ranging from about 20 to 25 degrees relative to a respective one of the adjacent vertical score lines 86–100. This angular relationship described above is very important to maintain proper foldability of the bottom flaps along the score fold lines to enable the larger dimensioned flaps to be folded inwardly in partially overlapping relationship upon themselves and with the smaller rectangular flaps 72, 76, 80 and 84 as best seen in FIGS. 1–5.

Generally, the preferred angle of the diagonal score fold lines is about 21½ to 23½ degrees, and more preferably about 22½ degrees relative to the respective vertical score fold lines 86–100. This angular relationship is preferred in accordance with the present invention to provide appropriate foldability of the closure flaps without significant binding or interference between the flaps during the folding process. However, the angle of the diagonal score fold lines 114 and 116 and 108 and 106 of at least one of the opposing pair of larger closure flaps 70 and 78 may range between 20 and 25 degrees respectively while maintaining the remaining diagonal score lines at about the preferred 22½ degrees and still achieve excellent foldability of the closure flaps. This latter modification is particularly useful when an overlap between the inwardly extending free edges of the opposing pair of larger closure flaps 70 and 78 is desired upon folding bottom 36 closed.

Changing the angles of the pair of diagonal fold lines on one of the larger closure flaps 70, for example, to about 20 degrees, and the diagonal fold lines on the opposing closure flap 78 to about 25 degrees effects the width of the free edges 122 and 126 when the closure flaps are folded. Such a change in these angles has the effect of minimizing interference between these two opposing free edges and the free edges of the adjacent closure flaps created during the folding process. However, any such interference between these particular free edges is also avoided if one of the opposing closure flaps, 70 or 78, is folded inwardly into a lowered position progressively sooner than the other in accordance with the method of folding disclosed herein. The angular relationship of the remaining diagonal fold lines such as 118 and 120, for example, should not deviate significantly from the preferred angle of about 22½ degrees plus or minus one degree to maintain good foldability characteristics. This assures that the width dimension of the portion of the free ends 122, 124, 126 and 128 which are folded in overlapping relationship is not greater than the width dimension of rectangular closure flaps 72, 76, 80 and 84 and will easily fold under the adjacent rectangular closure flaps without encountering significant interference. Significant interference in this regard results in the mere crushing or distortion of the box material in a haphazard manner rather than an orderly folding along the desired score fold lines. Crushing or distortion of the material not only makes foldability very difficult, but an undue amount also materially affects the desirable strength gains obtained as well as the appearance of the finished box product.

As shown in the more preferred embodiment illustrated in the drawings, the opposing parallel extending pair of side panels 20 and 28 are equal in width to one another and wider than the pair of the opposing parallel extending pair of side panels 24 and 32, which themselves are considerably wider than the side panels 22, 26, 30 and 34. However, side panels 20, 24, 28 and 32 could be equal in width to each other as a matter of choice if desired, and still function well in accordance with the present invention.

Figure 4:
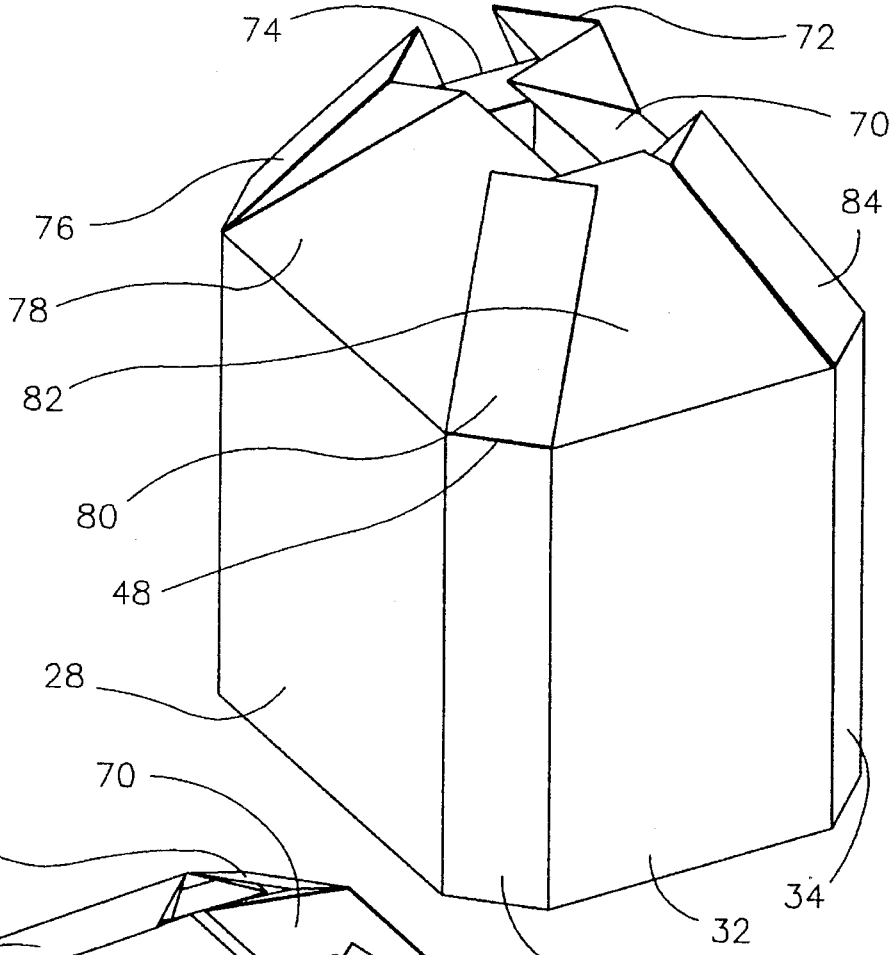
Figure 5:
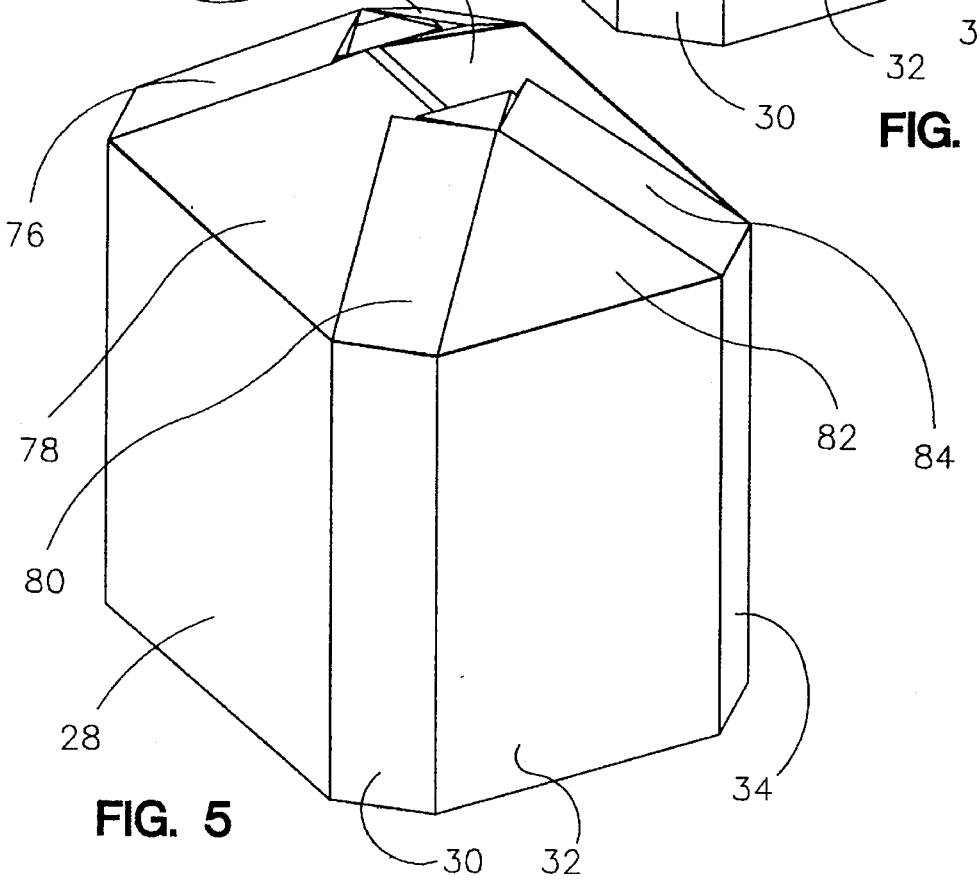

Compared to a prior art four sided configuration, the nature of folding the bottom closure flaps described above is relatively difficult because of the relatively close vertically extending score lines, as seen in FIG. 4, forming the smaller rectangular flaps 72, 76, 80 and 84, the relatively close distance of the diagonal score lines of the remaining flaps to the vertical fold lines, and the relatively small angular relationship of those diagonal score lines. This is particularly true in the more typical application where heavier fiberboard and/or a double wall thickness may be required to provide suitable strength for larger volumes of relatively heavy contents.

Therefore manual setting up of such a box configuration would be very difficult in such applications for most economically practical purposes. However, the important and very significant increases in strength as earlier noted herein which contribute very significant economical advantages can be realized if set up can be machine automated in a relatively simple, inexpensive and practical manner.

As best seen in FIGS. 8–13, an apparatus for setting up a box constructed in accordance with the present invention is illustrated. The box set-up fixture, indicated generally at 140, is shown in prototype form for simplicity without showing all the various mechanical actuators which may be chosen for causing movement of the main frame, pivoted plates and other moving parts which engage the box blank and cause the folding of the box along the scored fold lines described above. It is believed that the choice of mechanical actuators and their design is conventional and would be well understood to one of ordinary skill in the art given the following description of the apparatus and its functional operation. Preferably any moving parts of the frame and any moving fold plates would be actuated and controlled by an appropriate array of cylinder and piston assemblies conventionally mounted to or associated with a suitable frame and/or supporting base.

Figure 8:
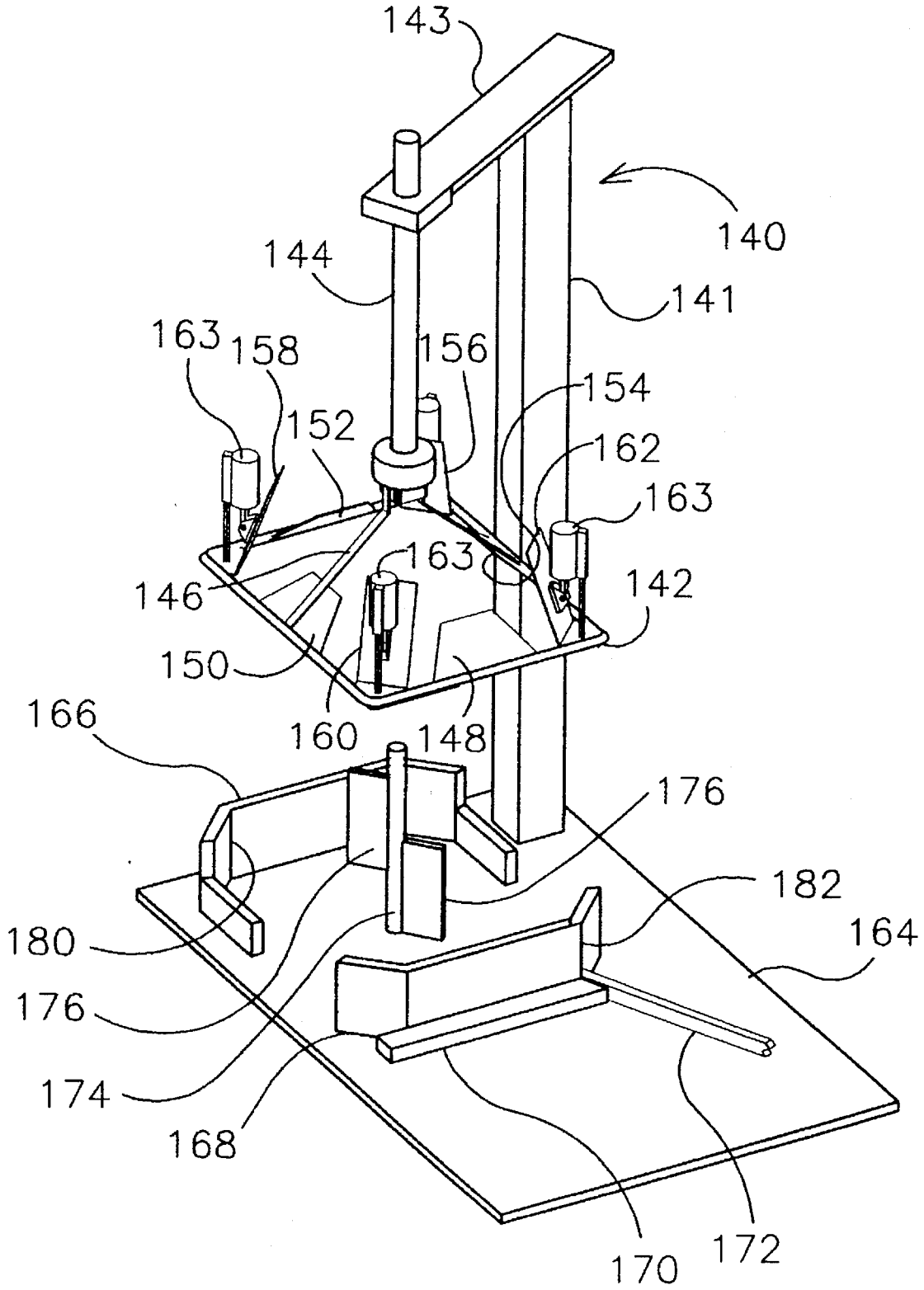
FIG. 8 is a perspective view of an apparatus for setting up the box shown in FIG. 1 constructed in accordance with the present invention.

Referring specifically to FIG. 8, a box set-up fixture, indicated generally at 140, includes a main frame 142 of generally rectangular configuration mounted for vertical movement along the axis of a central shaft 144. Shaft 144 may be supported in any conventional manner, such as by one or more vertical and horizontal supports 141 and 143. Preferably shaft 144 may be a piston rod driven by a conventional cylinder mounted in any conventional well-known manner to operate the raising and lowering of main frame 142 between a defined raised and lowered position. It is likely that a pair of spaced guide rods may be conventionally used to maintain the vertical movement of frame 142 in a stable and well defined vertical path in a well-known conventional manner.

Frame 142 includes a pair of supporting struts 146 and two pair of opposing fixed fold plates 148, 150, 152 and 154. One plate of each opposing pair is inclined inwardly toward the other one of the pair. Frame 142 also includes four pivoted or hinged fold plates 156, 158, 160 and 162 disposed at each corner of frame 142. Each of these pivoted plates are preferably connected to a suitable cylinder and piston assembly, such as 163, for movement between a generally vertical position and at least a generally horizontal position. The arcuate travel of the movable fold plates may be conventionally controlled by the stroke of the piston of the assembly 163.

Box set-up fixture 140 also includes a base 164 provided with a fixed five-sided box folding frame portion 166 generally conforming to the final angular configuration of five of the side wall panels of the eight-sided box to be formed and a movably mounted three-sided box folding frame 168 generally conforming to the angular configuration of the remaining three side wall panels of the box to be formed. The movable framework 168 is connected to a push bar 170 slideably mounted along base 164 by a push rod 172 which may be driven between extended and retracted positions by a suitable piston and cylinder arrangement, not shown, or other suitable conventional means in a conventional manner. Push rod 172 may be partially disposed in a guide track, not shown, provided in base 164 to better define its longitudinal path toward and away from fixed frame 166. Of course, either of the separated folding frame portions may be made movable relative to the other in any well-known manner suitable to obtain an equivalent function of causing the planar closed box to be suitably opened.

A center post 174 disposed in a vertical position is provided with a pair of opposing wing plates 176 and is rotatably mounted at a predetermined, generally centrally, located position on base 164 to aid in the proper and desired opening of the box blank as will be described in detail below.

Figure 9:
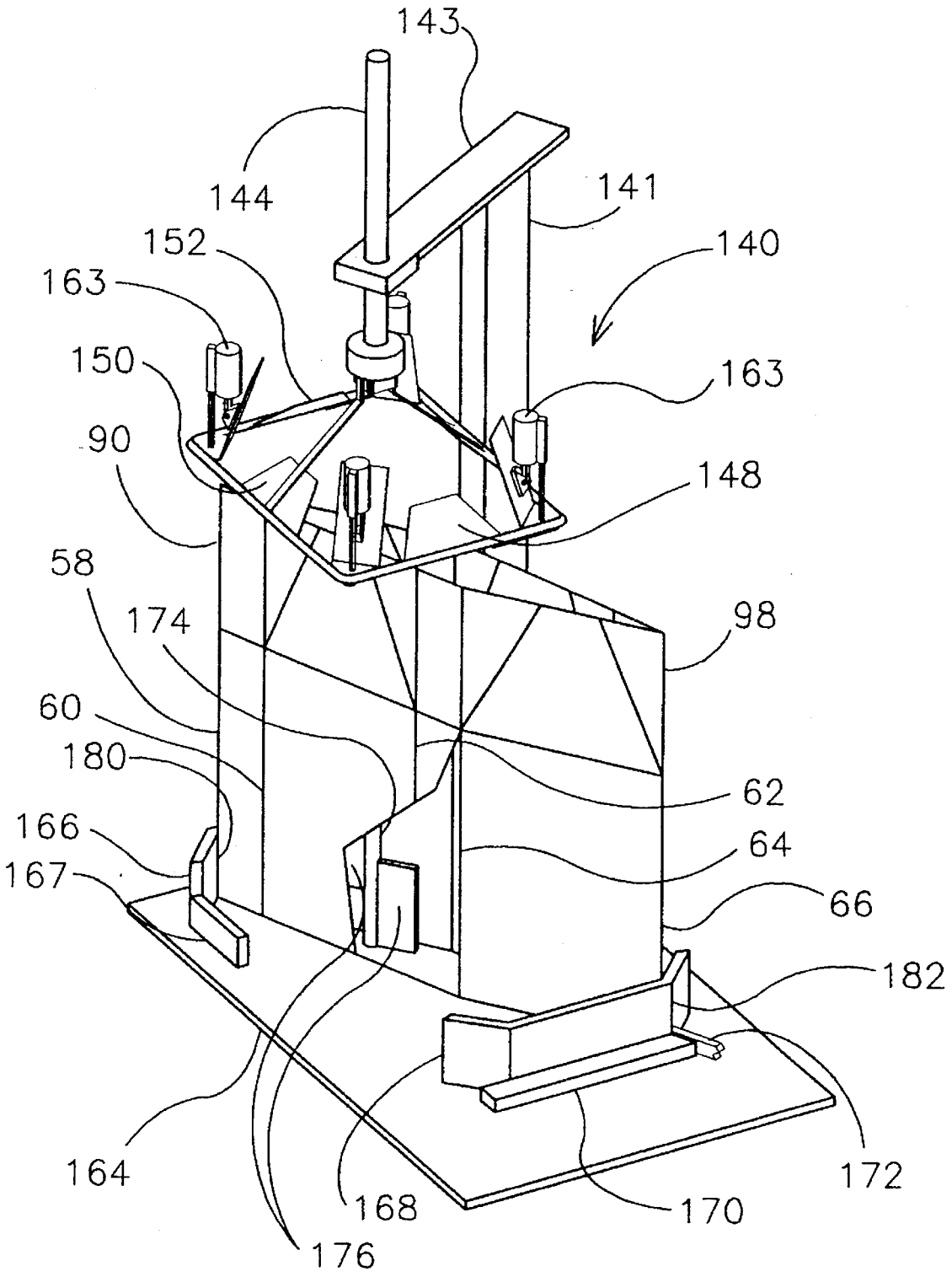
FIG. 9 is a perspective view of the apparatus shown in FIG. 8 and a box form from which a box such as shown in FIG. 1 is disposed in an initial position to start the set-up folding process in accordance with the present invention.

With main frame 142 disposed in its raised, non-interfering position, a planar closed box in tube form, as earlier described herein, is disposed in a vertical position above center post 174 and parallel to wings 176. The box form is then lowered to slide the vertical walls of the planar tube form over post 174 and wings 176 as shown in FIG. 9.

One corner of the planar closed box formed along fold lines 58 and 90 may be disposed against corner 180 of the fixed five-sided frame 166. The opposing corner formed by fold lines 66 and 98, as described earlier herein, is extended toward and aligned with corner 182 of movable frame 168 which is disposed in its retracted position, but aligned to move in a path to engage the corner formed by fold lines 66 and 98. Rod 172, actuated by any conventionally suitable means, causes push bar 170 and movable frame 168 to slide along the surface of base 164 toward center post 174 and causes corner 182 of the frame to engage the corner of the box form. Upon continued inward movement of frame 168 and rotation of post 174 and wings 176 through an angle of about 90 degrees, the box form is caused to open as it begins to fold outwardly along the vertical scored lines 54, 56, 60, 62, 64 and 68 and the associated extensions thereof 86, 88, 92, 94, 96 and 100 which form the width dimensions of the side panels and closure flaps.

Figure 10:
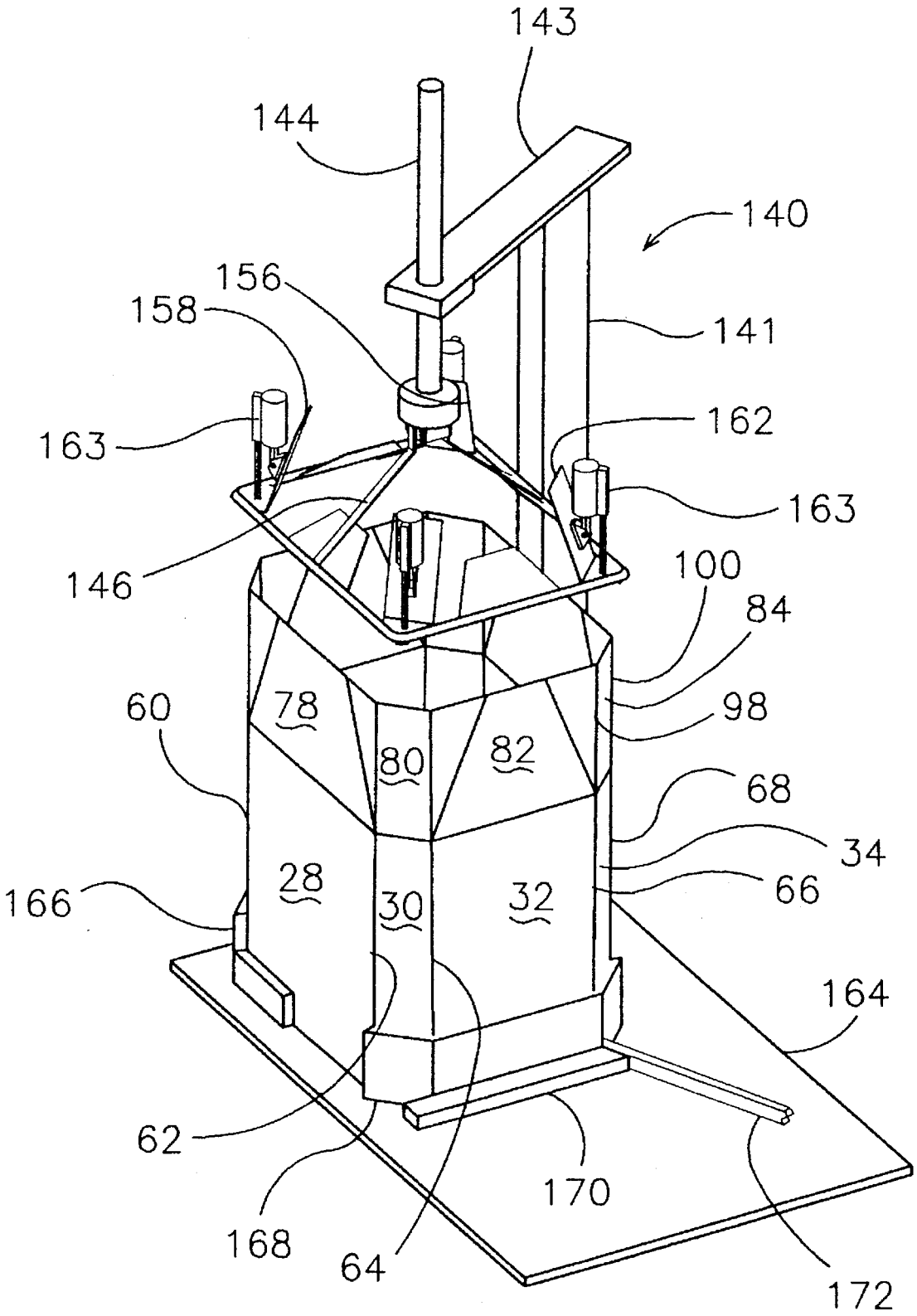
FIG. 10 is a perspective view similar to the view shown in FIG. 9 illustrating the initial step of set-up folding process of the box by the set-up apparatus shown in the preceding FIGS.
Figure 11:
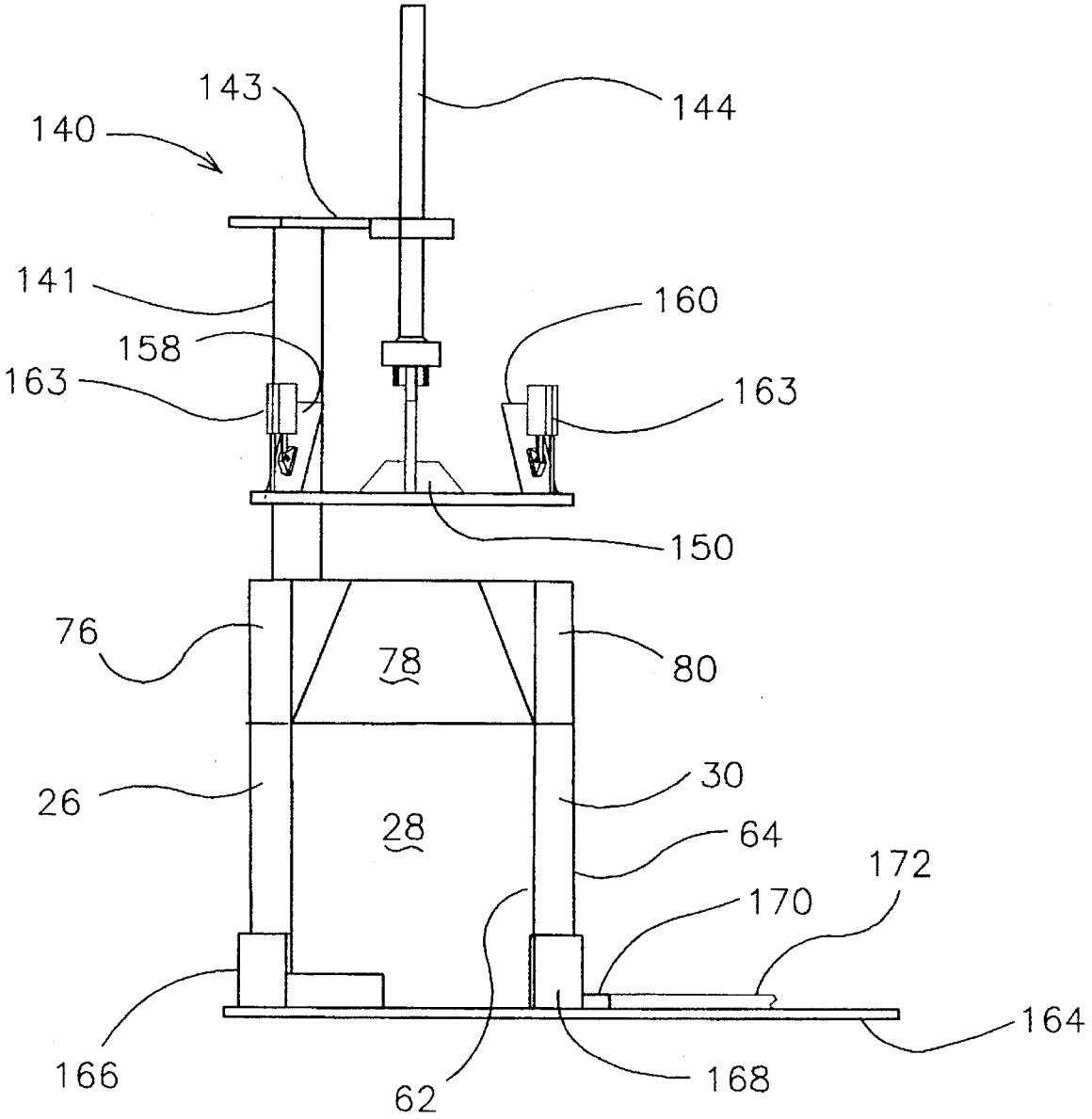
FIG. 11 is a side view of the apparatus and box at the same stage in the set-up folding process illustrated in FIG. 10.
Figure 12:
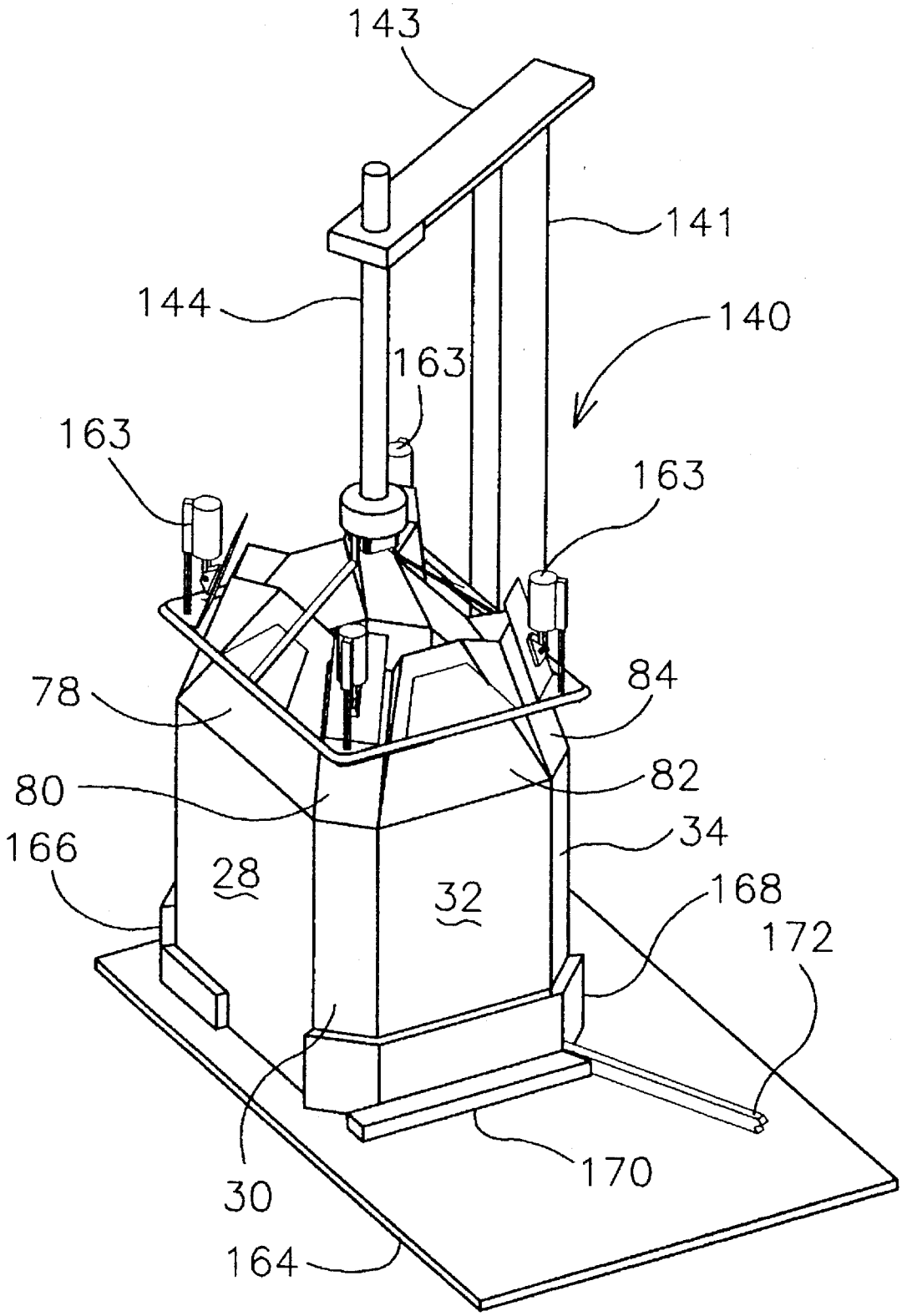
FIG. 12 is a perspective view of the set-up apparatus and the box shown in the preceding figures illustrating an initial step in the progressive folding of the bottom closure flaps of the box in accordance with the present invention.
Figure 13:
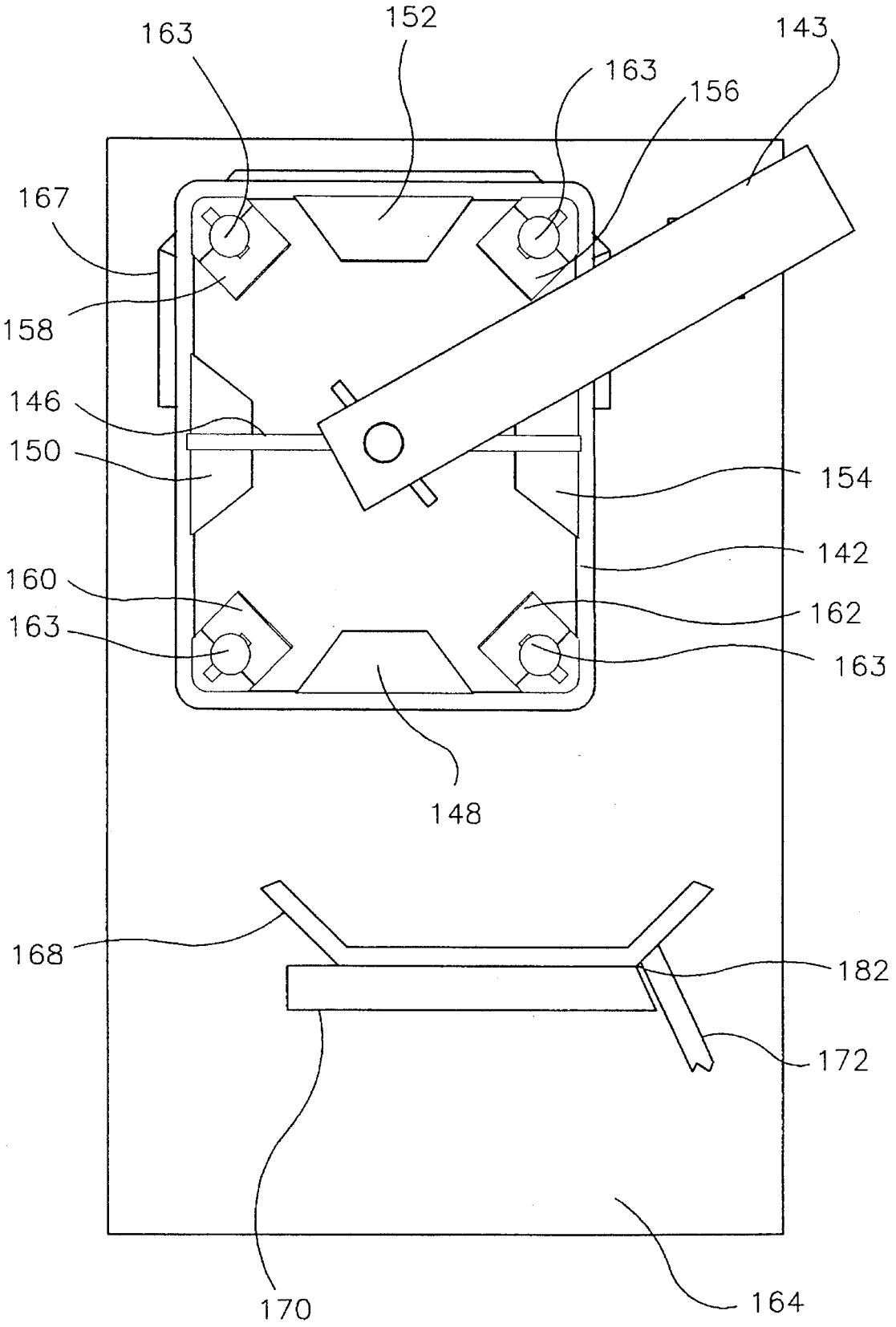
FIG. 13 is a top plan view of the set-up apparatus and the box being set-up at the same stage in the process as shown in FIG. 12.

The action of post 174 and wings 176 merely assures that the box opens as desired, that is, that the vertical score fold lines break or bend in the desired outward direction, to cause the box to fully open. The set up or opening of such a closed box form is generally referred to in the industry as "squaring up" the box to form the opened box. This initial opening of the box of the present invention is shown in FIG. 10. The stroke of push rod 172 may be controlled, such as by the stroke length of a suitable piston rod, to stop at a predetermined position essentially assuring the box is fully open and appropriately contained within the parameters defined by the frame 166 and 168. At this point all the vertical fold lines are folded in the desired disposition defining the desired eight-sided configuration.

At this point, main frame 142 is actuated and begins to lower in a manner causing fixed plates 148, 150, 152, and 154 to engage the larger closure flaps 70, 74, 78 and 82 above the horizontal score fold lines to begin to fold the closure flaps inwardly along the common horizontal score fold lines described earlier herein.

One of the opposing pair of plates 150 or 154 aligned with one of the larger pair of closure flaps 70 and 78 is preferably disposed at a lower inclined angle relative to the other to assure one of these opposing larger closure flaps will be engaged and caused to fold progressively sooner than the other. This feature is particularly beneficial when the inward extent of the opposing pair of flaps 70 and 78 is designed to overlap in the fully closed position. This overlapping occurs when the vertical height or inward extent of opposing closure flaps measured from the horizontal hinge line to the outer free edge is slightly greater than 50 percent of the width or smaller dimension between the larger two pair of side panels of the box. This progressive folding of one of the larger pair of opposing closure flaps relative to the other assures the closing sequence will progress without significant interfering engagement between the opposing pair of free edges of these larger flaps.

As the fixed plates 148–154 engage each of the closure flaps 70, 74, 78 and 82 via downward movement of frame 142, the flaps begin to fold inwardly along the horizontal fold lines 38–52, the diagonal fold lines 106, 108, 110, 112, 114, 116, 118 and 120 and along the vertical fold lines 86, 88, 90, 92, 94, 96, 98 and 100. As the engagement continues, the rectangular closure flaps 72, 76, 80 and 84 are also drawn inwardly, but to a lesser extent. The inward movement of the rectangular flaps during this initial folding step occurs because all of the closure flaps are integrally connected along the horizontal fold lines and the respective vertical fold lines described herein.

About at the point the lower edge of main frame 142 approaches a height defined by horizontal fold lines 38–55, pivoted plates 156,158, 160 and 162 are actuated to pivot downwardly into engagement with rectangular closure flaps 72, 76, 80 and 84. As these rectangular flaps are forced downwardly, they engage the adjacent larger flaps which have been partially folded inwardly. This action causes all of the closure flaps to continue to be folded and moved downwardly to form a substantially flat bottom in the fully closed position shown in FIG. 1.

As seen in FIGS. 1–6, the four larger closure flaps provided with the diagonal scored fold lines are partially folded in overlapping relationship upon themselves and in overlapping relationship with an adjacent smaller rectangular closure flap. In the fully closed position it will be seen that one of a pair of adjacent rectangular flaps partially overlies the corner of the other as best seen in FIG. 1.

In actual practice, the closure flaps are preferably caused to move beyond a horizontal position and tend to resiliently snap into this position when the folding process is complete due to the frictional engagement between the flaps which are caused to fold in the overlying relationship described herein.

Once the folding process is complete, frame 142 and push rod 172 carrying frame 168 and push bar 170 are caused to return to their initial starting positions and the box may be removed from base 164.

It should be pointed out that the set-up fixture 140 may be conventionally designed to be more automated if desired without departing from the present invention.

It is also important to note that the post 174 and associated wings 176 which initially assist in proper opening of the flattened tube or closed box form may be replaced by other means of accomplishing such a function. For example, a wedge shaped fixture may be used in place of post 174 and wings 176 to force the vertical sides of a closed tube or box partially open and reduce any tendency of the box folding into an L-shape instead of opening outwardly as it is engaged between the two frame portions 166 and 168. Additionally a pair of horizontally pivoted arms suitably mounted on a supporting frame and carrying suction cups at the outer ends could be advantageously used for this purpose. The arms could be pivoted to the frame to swing inwardly to engage the opposing sides of the planar closed box form with the suction cups. Using an appropriate vacuum pump, or the like, operatively connected to the cups to induce a negative pressure, permits such cups to be releasably secured to the outer surfaces of each side of box form. The arms carrying such cups would then be mechanically actuated to swing outwardly as folding frame portions 166 and 168 engage the corners of the planar box form. Such an outwardly directed force on opposing sides would tend to assure the desired outward folding of the box to perform the same function as post 174 and wings 176.

It is also contemplated that the base 164 and horizontal and vertical support numbers could be formed into a larger rectangular frame lifted above floor level in a commercial design of the apparatus with appropriate re-positioning of any mechanical actuators used to power the moving components.

It should also be noted that the fixed and movable folding frame portions 166 and 168 need not necessarily include the five and three wall portions as shown. These frame members can be re-positioned in other combinations to accommodate and correspond to the final octagonal configuration of the box.

However, one of these separated frame portions can not have less than two upstanding wall portions which correspond to the side wall panels of the box adjacent to one corner of the closed box form, such as corner 180 or 182, to assure the closed box form is properly forced open as described when the spaced frame portions are moved toward one another.

When the set-up opened box is used in a typical application as a bulk bin for storing loose or flowable materials, the closure flaps folded as described to form the bottom of the box, rest upon a planar surface such as a suitable pallet or the like. The weight of the contents holds the bottom closure flaps closed against the supporting pallet which is used to transport the loaded box to its desired destination. However, one may use suitable conventional means to fix the closure flaps in a closed position if deemed desirable for a particular application without departing from the spirit of the present invention.

In most typical applications, the open end of the box opposing bottom 36 will be covered with a fitted closure cap fixed to the box in a conventional manner so the contents may be secure during transit to a final destination. In some applications, such boxes or bulk bins may be stacked one upon another on a pallet. Also pallets carrying the boxes may be stacked one upon another.

Figure 7:
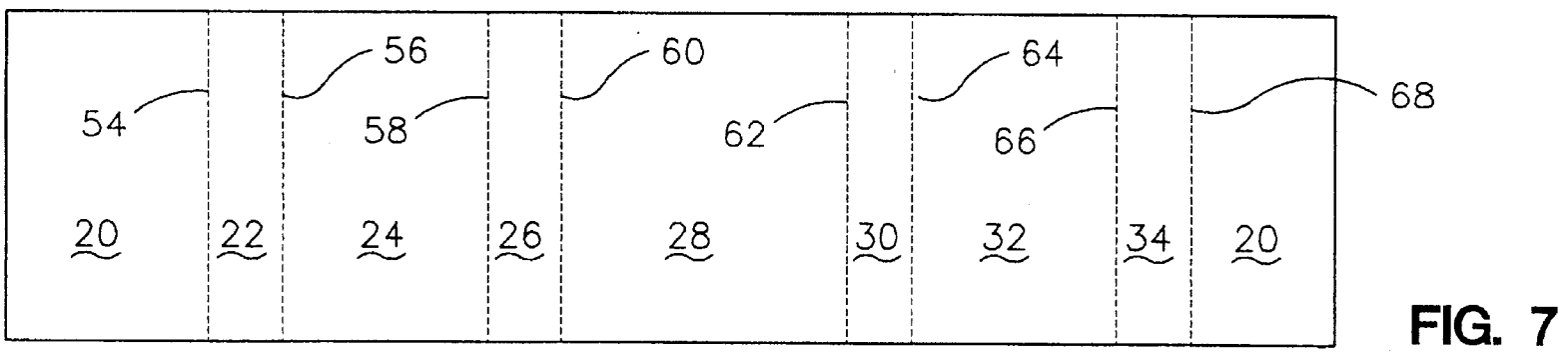
FIG. 7 is a plan view of an inner layer of paperboard which may be optionally used to reinforce the side panels of a box such as shown in FIG. 1 by adding an additional thickness to the side panels.

With specific reference to FIG. 7, an inner liner, indicated generally at 21, is preferably provided and also comprises a fiberboard material. Liner 21 is provided with a plurality of vertical score fold lines which are aligned with and correspond to the vertical score lines of the side panels shown in FIG. 6. Lamination of such a liner to a box blank such as shown in FIG. 6 is conventional in heavy duty box applications and merely provides vertical side panels of additional thickness for added strength. The liner is provided with essentially the same height dimensions as the vertical extent of the side panels and terminates at the horizontal score lines which form the hinge for the closure flaps. For simplicity, the side panels and vertical score fold lines of liner 21 are identified by the same reference numeral as the side panels and vertical score lines shown in FIG. 6 as upon conventional lamination using adhesive, the liner then forms an integral part of this portion of the box blank. The liner layer is affixed in overlapping relationship to the first layer of the box blank material during manufacture such that there is a corresponding portion of a single thickness of each layer of the blank material extending outwardly at each end. This arrangement is preferred so that upon overlapping the ends of the box blank 102 and 104 to form the manufacturer's joint, the overlapping portions of the joined ends form only a double thickness of the original fiberboard material used so the thickness of the side panels formed is essentially the same. This is a conventional practice in forming the manufacturer's joint in box making when an extra liner layer of fiberboard is used to strengthen the side walls of a box having a conventional configuration.

I claim:

1. An octagonal box structure formed from a planar blank of material comprising, in combination, a) four pair of upstanding side wall panels integrally connected together along horizontally spaced, vertical score hinge lines defining the width of each of said side wall panels to form an enclosed box structure, two pairs of said side wall panels having a substantially equal width relative to one another which is between about 20 to 40 percent of at least the smaller width dimension of the remaining two pairs of side wall panels;

b) eight closure flaps integrally connected to one another and each depending from one of said side panels along a common horizontal score hinge line for folding inwardly about said common horizontal score hinge line, each of said closure flaps including a free edge and a width dimension co-extensive with the width dimension of a corresponding side panel as defined by an extension of said vertical score hinge lines, four of said eight closure flaps being provided with a pair of score hinge lines extending diagonally from an adjacent corner of said box and terminating at the free edge of a respective one of said four closure flaps, each of said diagonal score lines defining an angle of about 20 to 25 degrees relative to an adjacent one of said extensions of said vertical score hinge lines; wherein each of said four closure flaps carrying said diagonally extending score hinge lines fold inwardly in partially overlapping relationship upon itself and with each immediately adjacent closure flap to close an end of said box structure.

2. The box defined in claim 1 wherein the angle between a respective one of said extension of said vertical score hinge lines and a respective one of said diagonal score hinge lines is between about 21½ to 23½ degrees.

3. The box defined in claim 1 wherein each of the four closure flaps provided with diagonally extending score hinge lines are co-extensive with and depend from a side wall panel of said remaining two pairs of side wall panels which have a greater width dimension than the two pairs of equal width side wall panels as defined in paragraph (a).

4. A blank of fiberboard material for forming an octagonal box configuration having at least an integrally formed top or bottom closure, comprising, in combination;

a) eight side wall panels having substantially an equal height dimension integrally connected together along vertically disposed, horizontally spaced, score hinge lines which define the corners of a fully set-up box configuration;

b) a first two pair of said side wall panels having a greater width dimension than a second two pair of said side wall panels;

c) said second two pair of side wall panels having approximately a width dimension equal to one another and about 20 to 40 percent of the width dimension of at least the smaller of the first two pair of side wall panels, each side wall panel of said second two pair being disposed between side wall panels of said first two pair;

d) eight closure flaps integrally connected to and depending outwardly from said side wall panels along a common generally horizontally disposed score hinge line for folding inwardly about said horizontally disposed score hinge line, each of said closure flaps having a width dimension co-extensive with the width dimension of a corresponding vertically aligned side wall panel as defined by an extension of said vertically disposed score hinge lines and each including a free edge;

e) a pair of diagonal score hinge lines provided on each of four of said closure flaps co-extensive with said first two pair of side wall panels, each of said diagonal score hinge lines extending toward one another from an intersection of one of said extensions of said vertical score hinge lines and said common horizontal score hinge line and terminating at a free edge of a respective one of said four closure flaps to form an angle relative to one of said extensions of said vertical score hinge lines between about 20 and 25 degrees; wherein each of said closure flaps having a pair of diagonal score hinge lines may be folded inwardly in partial overlapping relationship upon itself and with each immediately adjacent closure flap to form a top or bottom closure.

5. The blank defined in claim 4 wherein the angle of each of diagonal score hinge lines relative to a respective one of said extensions of said vertical score hinge lines is between about 21½ to 23½ degrees.

* * * * *